US010161120B2

(12) United States Patent
Tempel

(10) Patent No.: US 10,161,120 B2
(45) Date of Patent: Dec. 25, 2018

(54) SANITARY OUTLET INSERT

(71) Applicant: NEOPERL GMBH, Mullheim (DE)

(72) Inventor: Marc Tempel, Freiburg (DE)

(73) Assignee: NEOPERL GMBH, Mullheim (DE)

( * ) Notice: Subject to any disclaimer, the term of this patent is extended or adjusted under 35 U.S.C. 154(b) by 98 days.

(21) Appl. No.: 15/210,318

(22) Filed: Jul. 14, 2016

(65) Prior Publication Data

US 2016/0319527 A1 Nov. 3, 2016

Related U.S. Application Data

(63) Continuation of application No. 13/699,891, filed as application No. PCT/EP2011/001251 on Mar. 14, 2011, now Pat. No. 9,416,522.

(30) Foreign Application Priority Data

May 27, 2010 (GB) ..... 20 2010 007 202 U
Dec. 21, 2010 (GB) ..... 20 2010 016 867 U

(51) Int. Cl.

| | |
|---|---|
| ***E03C 1/08*** | (2006.01) |
| ***E03C 1/084*** | (2006.01) |
| ***B05B 1/30*** | (2006.01) |
| ***B05B 7/04*** | (2006.01) |
| *E03C 1/02* | (2006.01) |

(52) U.S. Cl.

CPC ..... *E03C 1/084* (2013.01); *B05B 1/3033* (2013.01); *B05B 1/3073* (2013.01); *B05B 7/0425* (2013.01); *E03C 1/08* (2013.01); *E03C 2001/026* (2013.01)

(58) Field of Classification Search

CPC ... B05B 1/3073; B05B 7/0425; B05B 1/3033; E03C 1/08; E03C 1/084; E03C 2001/026

USPC ..... 239/455–457, 428.5, 546

See application file for complete search history.

(56) References Cited

U.S. PATENT DOCUMENTS

| | | | |
|---|---|---|---|
| 4,562,960 | A | 1/1986 | Marty et al. |
| 6,131,608 | A | 10/2000 | Lu |
| 7,950,624 | B2 | 5/2011 | Liao |

FOREIGN PATENT DOCUMENTS

| | | | |
|---|---|---|---|
| FR | 2907874 | A1 | 5/2008 |
| WO | 2009079821 | A1 | 7/2009 |

*Primary Examiner* — Jason J Boeckmann

(74) *Attorney, Agent, or Firm* — Volpe and Koenig, P.C.

(57) ABSTRACT

A sanitary outlet insert which can be mounted on the water outlet of a sanitary outlet fitting, comprising a flow limiter that has an adjusting element which regulates or limits the flow area in cooperation with a counter element. The flow area of the flow limiter can be preselected or varied by an axial change of the relative position of the adjusting element and the counter element; in that additionally a handle is provided on the outlet end face of the outlet insert, said handle being designed as a pushbutton; and in that an adjusting movement on the handle can be converted into a relative axial movement of the adjusting element and the counter element by means of a pushbutton mechanism.

13 Claims, 13 Drawing Sheets

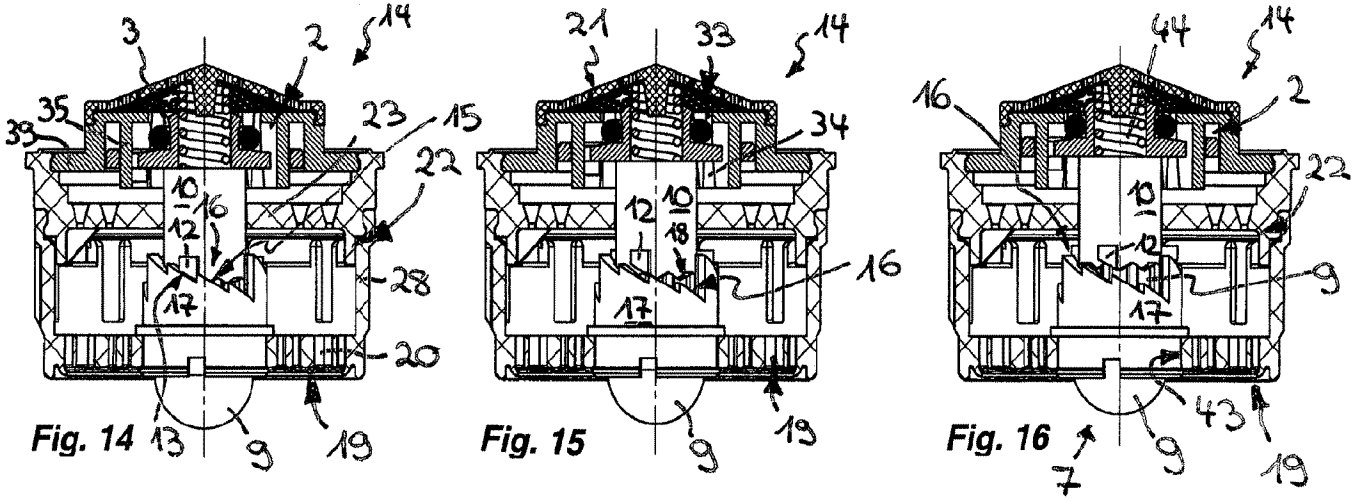
Fig. 14
Fig. 15
Fig. 16
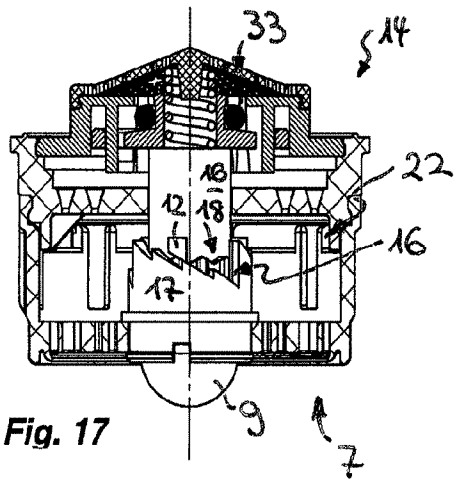
Fig. 17
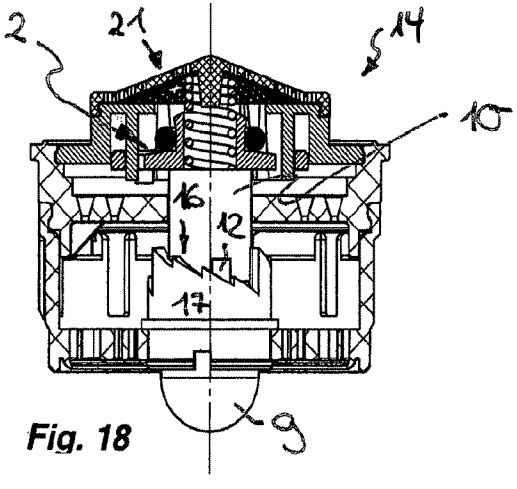
Fig. 18

SANITARY OUTLET INSERT

CROSS REFERENCE TO RELATED APPLICATIONS

This application is a continuation of U.S. patent application Ser. No. 13/699,891, filed Nov. 26, 2012, which is incorporated by reference as if fully set forth.

BACKGROUND

The invention relates to a sanitary outlet insert, which can be mounted on the water outlet of a sanitary outlet fitting, having a flow rate regulator or flow limiter that has an adjusting element which regulates or limits the flow cross section of the flow rate regulator or flow limiter in interaction with a counterelement, wherein a handle is provided on the outlet end of the outlet insert for the purpose of changing the relative position of the adjusting element and the counterelement, said handle being designed as a pushbutton, and wherein an adjusting movement at the handle can be converted into a relative movement of the adjusting element and the counterelement by means of a pushbutton mechanism.

Many standards already envisage limiting the quantity of water flowing out of an outlet fitting per unit time. Moreover, it may also be necessary to limit the flow line in order to ensure that the jet of water flowing out of the outlet fitting does not splash. Sanitary outlet inserts of the type mentioned at the outset which have a flow rate regulator or a flow limiter have therefore already been provided.

However, since the manufacturers of outlet fittings do not know the water pressure at the site of installation, and since this water pressure depends on the type of installation, e.g. on the use of pressure-increasing "booster pumps" or on water tanks installed on the roof, it is often necessary to supply a number of spare jet regulators designed for different flow rates for the outlet fittings, which are generally supplied on a trans-regional basis, it being possible to use these regulators selectively, depending on the on-site water pressure. However, providing a number of spare jet regulators, of which ultimately only one will be used, is associated with a considerable outlay.

Since many standards stipulate limiting the flow rate and since limiting the flow rate may also be necessary in order to ensure that the jet of water flowing out does not splash, omitting such jet regulators is not a solution either.

The prior art already includes various outlet inserts that can be used in the water outlet of a sanitary outlet fitting and, in addition to a jet regulator and/or a screen attachment, comprise a flow rate regulator or a flow limiter, the function of which is to limit the flow rate or to regulate the flow rate to a maximum value depending on the pressure. Although it is possible to reduce water consumption effectively with the aid of such outlet inserts, rapid filling and a correspondingly high volume flow is desirable for certain applications, e.g. when filling a pot or a water bucket.

FR 2 907 874 A has already disclosed a sanitary outlet insert of the type mentioned at the outset which can be mounted on the water outlet of a sanitary outlet fitting. In the housing interior of its housing, the previously known outlet insert has a rotatably mounted valve body, which has three intersecting channels opening at the circumference of the valve body. The previously known outlet insert has an annular pushbutton, which projects beyond the outlet end of the housing. In this arrangement, a manual pressure actuation of the pushbutton can be converted by means of a pushbutton mechanism into a stepwise turning movement of the valve body, such that the channel openings opening at the circumference of the valve body can be brought into overlap with an inflow-side inlet opening or with closed segments of the housing. Through the stepwise preselectability of the channel openings, which are oriented in the inflow or outflow direction, the flow cross section can be reduced in steps or completely shut off with the aid of the previously known outlet insert. However, regulation of the quantity of water flowing through per unit time to a maximum flow rate in a pressure-dependent manner is neither envisaged nor possible in the previously known outlet insert.

WO 2009/079821 A has already disclosed a shutoff valve which can be inserted instead of a commercially available jet regulator into a sleeve-shaped outlet nozzle that can be mounted on the water outlet of a sanitary outlet fitting. The shutoff valve already known from WO 2009/079821 A has a pushbutton which projects beyond the outlet end of the shutoff valve and with the aid of which a pushrod guided in an axially movable manner in the interior of the housing of the shutoff valve can be moved counter to the force of a restoring spring. The pushrod is of two-part design and has an inner rod part and an outer rod part, which are screwed together by means of a screw thread in such a way that the axial length of the pushrod can be changed. A water accumulation ring designed as a flexible hollow body, which can be filled with water via a bypass channel by the water flowing through the shutoff valve, is held on the pushrod. By means of manual pressure actuation of the pushbutton, which projects on the outflow side, the previously known shutoff valve is moved into the open position thereof. In the open position, the water accumulation ring is increasingly filled as time progresses, until the amount of water in the water accumulation ring is such that the change in hydraulic forces triggers the actuating movement of the shutoff valve back into the closed position. The shutoff valve already known from WO 2009/079821 A is provided for public washrooms. In that context, the previously known shutoff valve offers not only the advantage that the pushbutton, which is situated in the outflowing stream of water, is thus continuously cleaned but also that the shutoff valve moves into its shutoff position automatically after a preselectable time interval. Here, the time interval specified for the open position of the shutoff valve can be preselected by changing the length of the pushrod.

SUMMARY

It is the object to provide a sanitary outlet insert of the type mentioned at the outset in which the flow rate can be adapted easily to the on-site water pressure and/or to the respective application, and it should preferably also be possible to use the outlet insert in existing outlet fittings, in particular without the need to replace the outlet nozzle.

In the case of the sanitary outlet insert of the type mentioned at the outset, the solution to this problem according to the invention consists, in particular, in the fact that the flow cross section of the flow rate regulator or flow limiter can be preselected or varied between a high flow rate and at least one flow rate that is reduced relative to the latter by an axial change of the relative position of the adjusting element and the counterelement, and that the outflow end of the outlet insert has a central through opening, through which the pushbutton passes.

The outlet insert according to the invention can be inserted into the water outlet of a sanitary outlet fitting in order to enable the flow rate to be adapted to the on-site water pressure or to the application which is the occasion for the drawing operation. For this purpose, the outlet insert according to the invention has a flow rate regulator or flow limiter that has an adjusting element which regulates or limits the flow cross section of the flow rate regulator or flow limiter in interaction with a counterelement. In order to be able to preselect or vary the flow cross section of the flow rate regulator or flow limiter, which cross section determines the flow rate, by an axial change of the relative position of the adjusting element and the counterelement, a handle is provided on the outlet end of the outlet insert. In this arrangement, an adjusting movement at the handle is converted into an axial relative movement of the adjusting element and the counterelement. In order to be able to change or adapt the flow rate of the outlet insert according to the invention quickly and easily, this handle is designed as a pushbutton which passes through a central through opening provided at the outlet end of the outlet insert. In this arrangement, an adjusting movement at the handle can be converted into an axial relative movement of the adjusting element and the counterelement by means of an actuating or pushbutton mechanism. With the aid of this actuating or pushbutton mechanism, the flow rate of the outlet insert according to the invention can be switched from a setting with a defined flow rate to at least one setting with a flow rate that differs from the latter simply by exerting pressure on the handle designed as a pushbutton. Since the outlet insert according to the invention is designed as a sanitary insert unit, said unit can also be designed in such a way that the outlet insert can also be substituted retrospectively for a conventional jet regulator insert in the already existing outlet fittings without the need to replace the existing outlet nozzle as well.

A preferred development according to the invention envisages that the pushbutton mechanism has a thruster sleeve, by means of which the relative position of the adjusting element and the counterelement can be changed and that the thruster sleeve has at least one sliding tooth with an oblique surface, which oblique surface interacts with a circumferential stepped set of teeth, such that a pressing movement applied to the pushbutton counter to a restoring force can be converted into an axial sliding/turning movement of the sliding tooth, which, during this process, slides into the next step of the stepped set of teeth. The pushbutton, the thruster sleeve with the at least one sliding tooth, which has an oblique surface, and the stepped set of teeth, which interacts with the oblique surface on the sliding tooth, thus form a pushbutton or actuating mechanism which corresponds to the actuating mechanism of a conventional retractable ballpoint pen.

In order to be able to provide a plurality of pre-selectable flow cross sections or flow rates by means of the outlet insert according to the invention, it is advantageous if the stepped set of teeth is of two- or multi-step design.

In this case, a simple and advantageous embodiment according to the invention envisages that, in one step of the two- or multi-step stepped set of teeth, the adjusting element is arranged outside an operative position provided in the region of the counterelement. If the adjusting element is within at least one operative position provided in the region of the counterelement, the adjusting element and the counterelement can interact in such a way that the flow rate of the outlet insert according to the invention can be regulated or limited. If, on the other hand, the adjusting element is arranged outside an operative position provided in the region of the counterelement, the adjusting element and the counterelement cannot interact, and it is thus possible to provide a setting with a flow rate that is higher than the above, for example.

An actuating mechanism which saves space and can also be accommodated in the insert housing of the outlet insert according to the invention, and which can be produced with little outlay and embodied in a functionally reliable manner, envisages that the thruster sleeve is guided in a guide sleeve, which bears the circumferential stepped set of teeth at one end edge of the sleeve or on the inner circumference of the sleeve.

A preferred embodiment according to the invention envisages that the outflow-side end wall of the insert unit has a grille, net or hole structure and that the guide sleeve is formed integrally or secured on the end wall. If the outflow-side end wall of the outlet insert has a grille, net or hole structure, the jet of water emerging from the outlet insert according to the invention can be shaped and formed into a homogeneous jet of water which does not splash, for example.

To ensure that the thruster sleeve can be guided in an axially movable and, at the same time, rotatable manner and hence that a pressing movement on the pushbutton can be converted into an axial sliding/turning movement of the at least one sliding tooth projecting from the thruster sleeve, a preferred development according to the invention envisages that the thruster sleeve is guided in a guide sleeve, which bears the circumferential stepped set of teeth at one end edge of the sleeve or on the inner circumference of the sleeve.

The restoring force, which also acts on the pushbutton, can be provided by embodying at least one individual component of the individual components provided in the actuating mechanism with spring-type elasticity and/or by means of an elastomeric restoring element. In addition or instead, it may be advantageous for the restoring force to be embodied as a restoring spring.

A particularly space-saving and functionally reliable embodiment according to the invention envisages that the restoring spring passes through the thruster sleeve.

Movement of the pushbutton of the outlet insert according to the invention in the axial direction by pressure actuation can be accomplished particularly well if the pushbutton is guided movably in the guide sleeve.

In order to be able to shape the jet of water emerging from the outlet insert according to the invention in an effective manner into a homogeneous jet of water which does not splash and, if appropriate, is also gently effervescent, a preferred development according to the invention envisages that a jet regulator is arranged downstream of the flow rate regulator or the flow limiter.

A particularly functionally reliable and fault-free embodiment according to the invention, which at the same time can also be embodied in a very space-saving manner, envisages that the flow rate regulator is arranged in the insert unit between the outflow-side jet regulator and an inflow-side screen attachment.

To ensure that the restoring spring can apply its restoring force in an effective manner to the actuating mechanism within the outlet insert according to the invention, one embodiment according to the invention envisages that the restoring spring is supported on the thruster sleeve and/or on the screen attachment.

If a jet regulator is provided in the outlet insert according to the invention, it can be designed as an unaerated jet regulator. However, in order to aerate the jet of water emerging from the outlet insert according to the invention and hence to be able to shape it into a gently effervescent jet of water, an embodiment in which the jet regulator is designed as an aerated jet regulator is preferred.

In the case of an outlet insert of this kind comprising an aerated jet regulator, it is advantageous if the jet regulator has a jet divider which divides the inflowing water into a multiplicity of individual jets to be aerated.

A particularly simple, compact and quiet embodiment according to the invention envisages that the jet divider is designed as a perforated plate.

However, in order to be able to aerate the individual jets produced in the jet divider of the outlet insert according to the invention well and effectively, even at low water pressures, a development according to the invention is preferred in which the jet divider is designed as a diffuser, which has an annular wall with through openings, and in which a deflecting surface is formed on the annular wall, said deflecting surface deflecting the inflowing water to the through openings.

In order to be able to draw the ambient air into the outlet insert according to the invention and mix it there with the individual jets produced by the jet divider, it is advantageous if the jet regulator has a jet regulator housing with a housing subregion which, between itself and the diffuser, bounds a through channel, if the through channel tapers at least in one or more regions in the direction of flow, and if the through openings open into the through channel. Since, in this embodiment, the through channel bounded between the housing and the diffuser tapers in the direction of flow, the individual jets produced in the diffuser are accelerated in such a way that, in accordance with Bernoulli's equation, a reduced pressure is generated on the outflow side of the through channel, causing the ambient air to be drawn into the jet regulator of the outlet insert according to the invention.

In order to be able to produce the individual parts of the outlet insert according to the invention in as simple a manner as possible and in order to reduce the outlay associated with the production of the outlet insert according to the invention, it is advantageous if the jet regulator has a jet regulator housing with at least two releasably connectable housing parts.

The jet of water emerging from the insert unit can be shaped particularly effectively into a jet of water which is homogeneous and does not splash if the jet regulator has a jet regulator housing, into the housing interior of which at least one inserted part having a hole, grille or net structure can be inserted, said inserted part acting as a jet shaping part.

The adjusting movement exerted on the pushbutton can be transmitted particularly effectively to the adjusting element if the adjusting element is guided in such a way as to be axially adjustable.

It can be advantageous if the pushbutton is produced from a transparent or semitransparent material in order to indicate the selected pressure level.

In order to avoid unintentional incorrect actuations or unwanted interference with the outlet insert according to the invention, it may be advantageous if the pushbutton is provided in such a way in a set-back position on the outlet insert that the pushbutton can only be actuated with the aid of an actuating tool.

Another embodiment according to the invention envisages that, to actuate the pushbutton mechanism, the pushbutton must preferably be pushed into the outlet insert, in particular beyond the plane formed by the outlet end of the outlet insert, e.g. by means of the tip of the fingernail. In this advantageous embodiment too, unintentional incorrect actuations of the outlet insert are avoided. Moreover, the recessed pressure point prevents the screen attachment supporting the pressure mechanism from being protected from overloading by the application of an impermissibly large adjusting force or an over-long adjustment travel.

A preferred development according to the invention envisages that the flow rate regulator has a throttling body made of flexible material, which, between itself and at least one regulating profile provided on a circumferential wall, delimits at least one control gap, the passage cross section of which changes under the pressure of the water flowing through, and that the flow cross section of the flow rate regulator can be preselected or varied by an axial change of the relative position of the throttling body and the regulating profile.

It can be expedient here if the adjusting element carries the throttling body or the at least one circumferential wall having a regulating profile.

In order to be able also to preselect various flow rates, if required, it is expedient if the circumferential wall bearing the regulating profile bounds a flow cross section which tapers in or counter to the direction of flow, and/or if the regulating profile has flow grooves or molded flow recesses, which are oriented in the direction of flow and the clear flow cross section of which tapers or widens.

BRIEF DESCRIPTION OF THE DRAWINGS

Developments according to the invention will emerge from the following description in conjunction with the claims and the drawing. The invention is described in greater detail below with reference to preferred illustrative embodiments.

In the drawings:

FIGS. 14 to 18 show an outlet insert comparable to that in FIGS. 1 to 4 in various longitudinal sections, in which outlet insert the flow rate can be adjusted between four different levels, wherein FIGS. 14 to 18 show the outlet insert in a sequence during an actuating process.

DETAILED DESCRIPTION OF THE PREFERRED EMBODIMENTS

Figure 9:
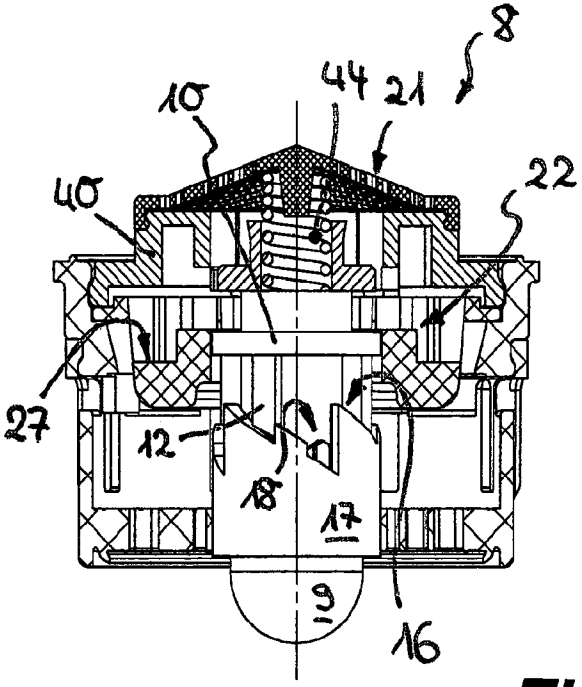
FIG. 9 shows the outlet insert from FIG. 8, likewise illustrated in a longitudinal section, in a different operating position from that in FIG. 8.
Figure 8:
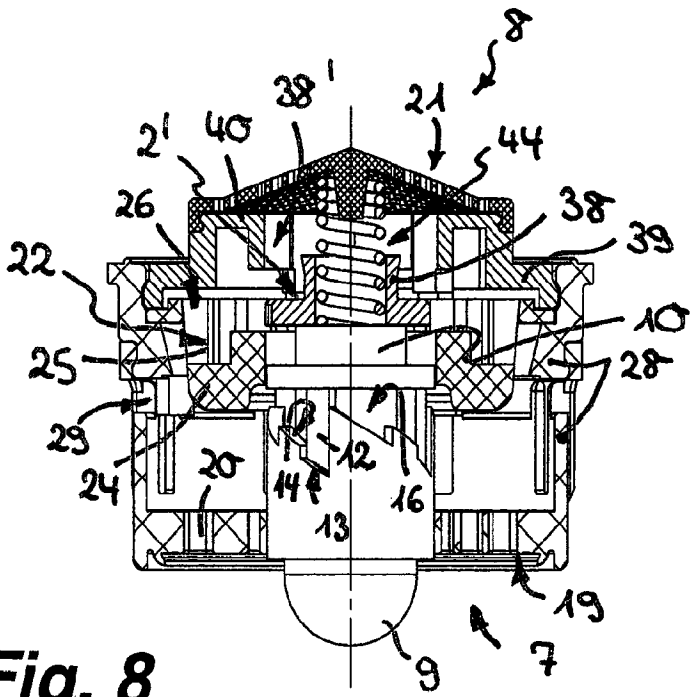
FIG. 8 shows an outlet insert of comparable configuration to that in FIGS. 5 to 7, which here has a flow limiter instead of a flow rate regulator.
Figure 10:
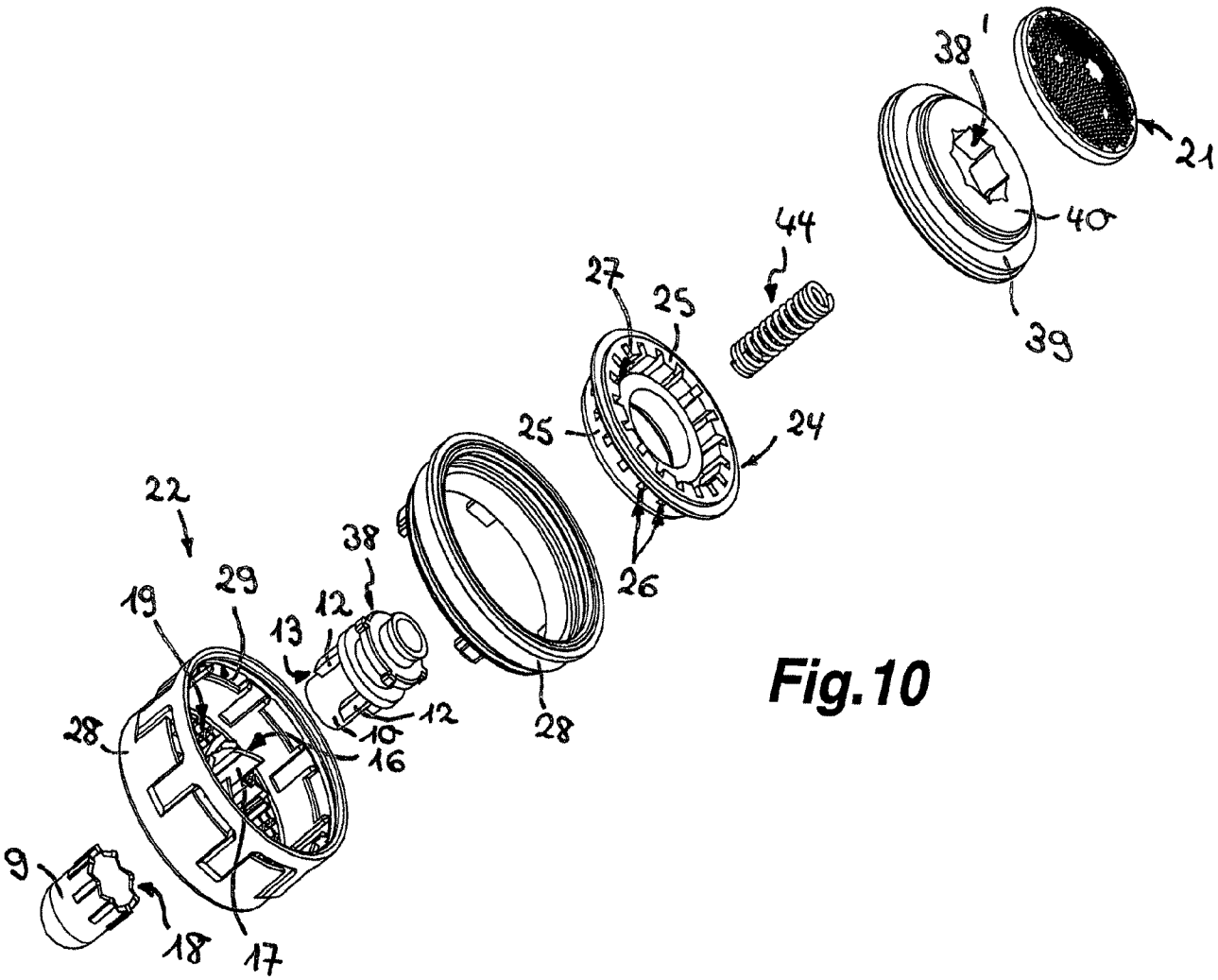
FIG. 10 shows the outlet insert from FIGS. 8 and 9 in an exploded illustration of individual components.

Various embodiments 1, 5, 8, 11, 14 and 50 of a sanitary outlet insert are illustrated in FIGS. 1 to 22. The outlet inserts 1, 5, 8, 11, 14, 50 can be inserted into an outlet nozzle (not shown here), which can be mounted on the water outlet of a sanitary outlet fitting (likewise not shown). While the outlet inserts 1, 5, 11, 14 and 50 have a flow rate regulator 2, a flow limiter 2' is provided in the outlet insert 8 shown in FIGS. 8 to 10. The flow rate regulators 2 and the flow limiter 2' have an adjusting element 3, 4, 6 or 38, which interacts with a counterelement 3', 4', 6' or 38'. While it is the function of the flow rate regulators 2 to regulate the flow cross section to a maximum flow rate (volume flowing through per unit time) independent of the water pressure, the flow limiter 2' is intended merely to limit the flow cross section and reduce the flow rate accordingly.

It will be apparent from FIGS. 1 to 22 that a handle is provided on the outlet end 7 of the outlet insert 1, 5, 8, 11, 14. Here, an adjusting movement at the handle is converted into an axial relative movement of the adjusting element 3, 4, 6, 38 and the counterelement 3', 4', 6', 38'. The handle is designed as a pushbutton 9, which projects beyond the outlet end 7 of the outlet insert 1, 5, 8, 11, 14, 50 and can be moved axially on the outlet insert 1, 5, 8, 11, 14, 50 in a direction toward the latter, against the restoring force of a restoring spring 44, by exerting pressure.

The relative position of the adjusting element 3, 4, 6, 38 and the counterelement 3', 4', 6', 38' can be adjusted by means of a thruster sleeve 10. This thruster sleeve 10, which is part of a pushbutton mechanism, has sliding teeth 12, which are spaced apart around the outer circumference of the thruster sleeve 10. The axial end face of the sliding teeth 12 which faces the pushbutton 9 is in each case designed as an oblique surface 13, which interacts with a corresponding counterbevel 15 on a stepped set of teeth 16. This stepped set of teeth 16 is provided on the inner circumference (cf. FIGS. 13 and 21) or on the axial end wall (cf. FIGS. 1 to 10, 14 to 19) of a guide sleeve 17, in which the thruster sleeve 10 is guided in an axially movable manner. The oblique surfaces 13 of the sliding teeth 12 can slide along the counterbevels 15 of the guide sleeve 17 in such a way that a pressing movement applied to the pushbutton 9 counter to the restoring force can be converted into an axial sliding/turning movement of the sliding teeth 12, which slide into the next step of the stepped set of teeth 16 during this process.

From FIGS. 1 to 22 and, in particular, from the time sequence in FIGS. 14 to 18, it can be seen that the pushbutton 9 has a sleeve-shaped front end region, which bears a set of teeth 18 running around in a crown shape. When pressure is exerted on the sleeve-shaped front end region of the pushbutton 9, which end region is guided between the inner circumference of the guide sleeve 17 and the outer circumference of the thruster sleeve 10, the crown-shaped set of teeth 18 thereof is pushed forward toward the sliding teeth 12 of the thruster sleeve 10 until said teeth lift off from the counterbevels 15 on the guide sleeve 17. In this case, the crown-shaped set of teeth 18 of the pushbutton 9 is offset in such a way relative to the counterbevels 15 on the guide sleeve 17 and to the sliding teeth 12 on the thruster sleeve 10 that, after lifting off from the stepped set of teeth 16, the sliding teeth 12 simultaneously also perform a turning movement, which may be reinforced by the restoring element if required, and after returning the pushbutton 9 to the initial position, can engage in the next step of the stepped set of teeth 16.

The stepped set of teeth 16 is of two- or multi-step design. In this case, each stepped set of teeth 16 has a step sequence which is repeated in the circumferential direction in such a way that the sliding teeth 12, which rotate further in one direction with each actuating operation, move further up the step sequence step by step and, after reaching the highest step, fall back into the initial step.

Here, the outflow-side end wall 19 of the outflow inserts 1, 5, 8, 11, 14, 50, which is provided at the outflow end 7, is designed as a hole structure, which has through flow holes 20 similar to honeycomb cells, for example. The outflow-side end wall 19 has a central through opening 43, through which the pushbutton 9 passes. The through opening 43 provided on the end wall 19 is surrounded by the guide sleeve 17, which can be formed integrally (cf. FIGS. 7 and 10) or secured releasably (cf. FIGS. 3, 4, 19) on the jet regulator or diffuser (cf. FIGS. 20 and 21) or on the end wall 19.

In FIGS. 1 to 22, it can be seen that a screen attachment 21, in particular a conical screen attachment 21, the function of which is to filter out dirt particles carried by the water, is arranged upstream of the flow rate regulator 2 or the flow limiter 2'. Arranged downstream of the flow rate regulator 2 or the flow limiter 2' is a jet regulator 22, the function of which is to shape the outflowing water into a homogeneous jet of water which does not splash. Here, the jet regulator 22 of the outlet inserts 1, 5, 8, 11, 14, 50 is designed as an aerated jet regulator and has a jet divider, which divides the inflowing water into a multiplicity of individual jets which are to be aerated. While the jet divider of the outlet inserts 1, 14 is designed as a perforated plate 23, the jet divider of outlet inserts 5, 8, 11, 50 is designed as a diffuser 24. The diffuser 24 has an annular wall 25, which has through openings 26 uniformly spaced apart in the circumferential direction. A deflecting surface 27 is formed integrally on the annular wall 25 and deflects the inflowing water to the through openings 26. The aeration openings 29 provided in the jet regulator housing 28 of the outlet inserts 1, 5, 8, 11, 14, 50 open into a through channel 30 running round in a ring shape, which is provided between the diffuser 24 and the adjacent housing subregion of the jet regulator housing 28. This through channel 30 tapers in the direction of flow in such a way that the individual jets produced in the diffuser 24 undergo an acceleration, which produces a reduced pressure in that subregion of the housing interior of the jet regulator housing 28 which follows the through channel 30, causing the ambient air required to aerate the individual jets to be drawn into the interior of the housing. Since the individual jets produced by the perforated plate 23 produce a comparable reduced pressure, the aeration openings 29 through which the ambient air can enter the interior of the housing are provided in the housing wall of the jet regulator housing 28. The end wall 19, which in this case has a hole structure, simultaneously provides the jet regulator 22 with a flow straightener, the function of which is to shape the individual jets aerated in the interior of the housing into a homogeneous and gently effervescent overall jet.

As will be clear from the Figures, the flow rate regulator 2 or the flow limiter 2' is integrated as a component part into the jet regulator housing 28 of the outlet inserts 1, 5, 8, 11, 14 and 50.

It goes without saying that it is also possible, instead of the jet aerator illustrated here, for a laminar or unaerated jet regulator, a flow straightener or some other jet shaping device to be arranged downstream of the flow rate regulator 2 or the flow limiter 2'.

The flow rate regulators 2 provided in the outlet inserts 1, 5, 11, 14 and 50 have an annular throttling body 31 made of flexible material. Between itself and a regulating profile 32 provided on a circumferential wall, the throttling body 31 delimits a control gap 33. Since, with increasing pressure, the throttling body 31 is increasingly deformed and pressed into the regulating profile 32, the passage cross section of the control gap 33 is modified by the pressure of the water flowing through. While the regulating profile of the outlet inserts shown in FIGS. 1, 5 and 11 has an approximately constant cross section, such that, in these outlet inserts, the throttling body can be switched into only two operating positions relative to the regulating profile, either in or out of use, FIG. 14 shows by way of example an embodiment in which the circumferential wall bearing the regulating profile 32 tapers in or counter to the direction of flow and/or in which—as in FIG. 14—the grooves or similar molded recesses 34 forming the regulating profile 32, said grooves or recesses being oriented in the direction of flow, widen in or counter to the direction of flow, making it possible, through axial adjustment of the relative position of the adjusting element 3, 4 and the counterelement 3', 4', to vary the flow cross section of the flow rate regulator 2 in stages if required. Whereas, in outlet inserts 1, 5, 14, the adjusting element 3, 4 carries the flexible throttling body 31, the adjusting element 6 in outlet inserts 11, 50 bears the regulating profile 32 on its outer circumferential wall, and the regulating profile 32 is surrounded by the throttling body 31, which is secured axially in the flow rate regulator 2.

The adjusting element 3 of outlet inserts 1 and 14, which carries the throttling body 31, is designed in the form of a spoked wheel, wherein guide webs 35 of the flow rate regulator housing 36 pass through the spoke openings 37 in such a way that the adjusting element 3 is guided in the outlet insert 1, 14 in a manner which prevents relative rotation but allows axial movement.

Figure 2:
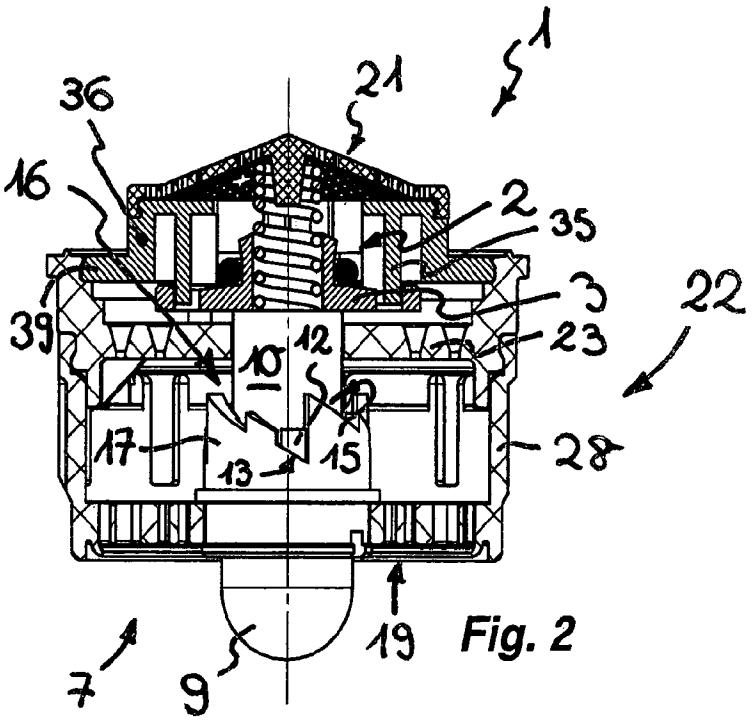
FIG. 2 shows the outlet insert from FIG. 1 in a different operating position from that in FIG. 1.
Figure 1:
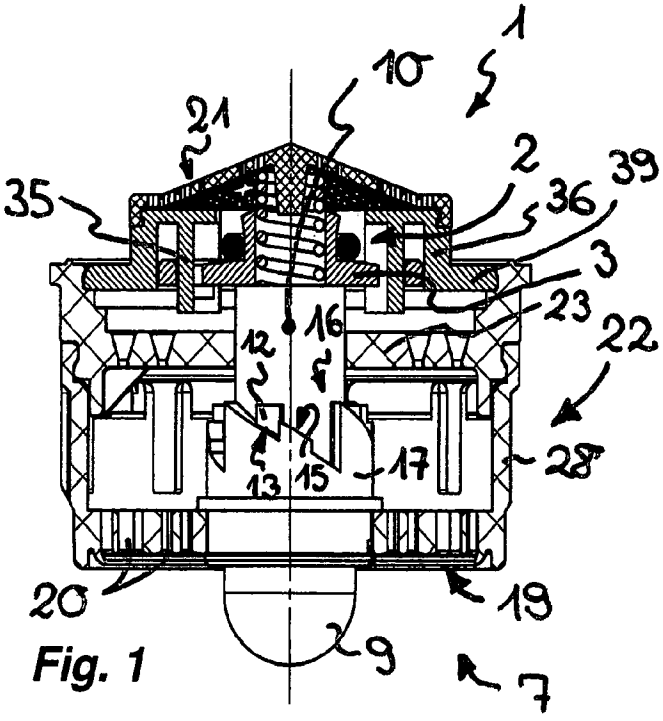
FIG. 1 shows an outlet insert, illustrated in a longitudinal section, which can be mounted in the water outlet of a sanitary outlet fitting and, between an inflow-side screen attachment and an outflow-side jet regulator, has a flow rate regulator, the flow rate of which can be preselected in steps at a handle designed as a pushbutton projecting beyond the outflow side of the outlet insert.
Figure 3:
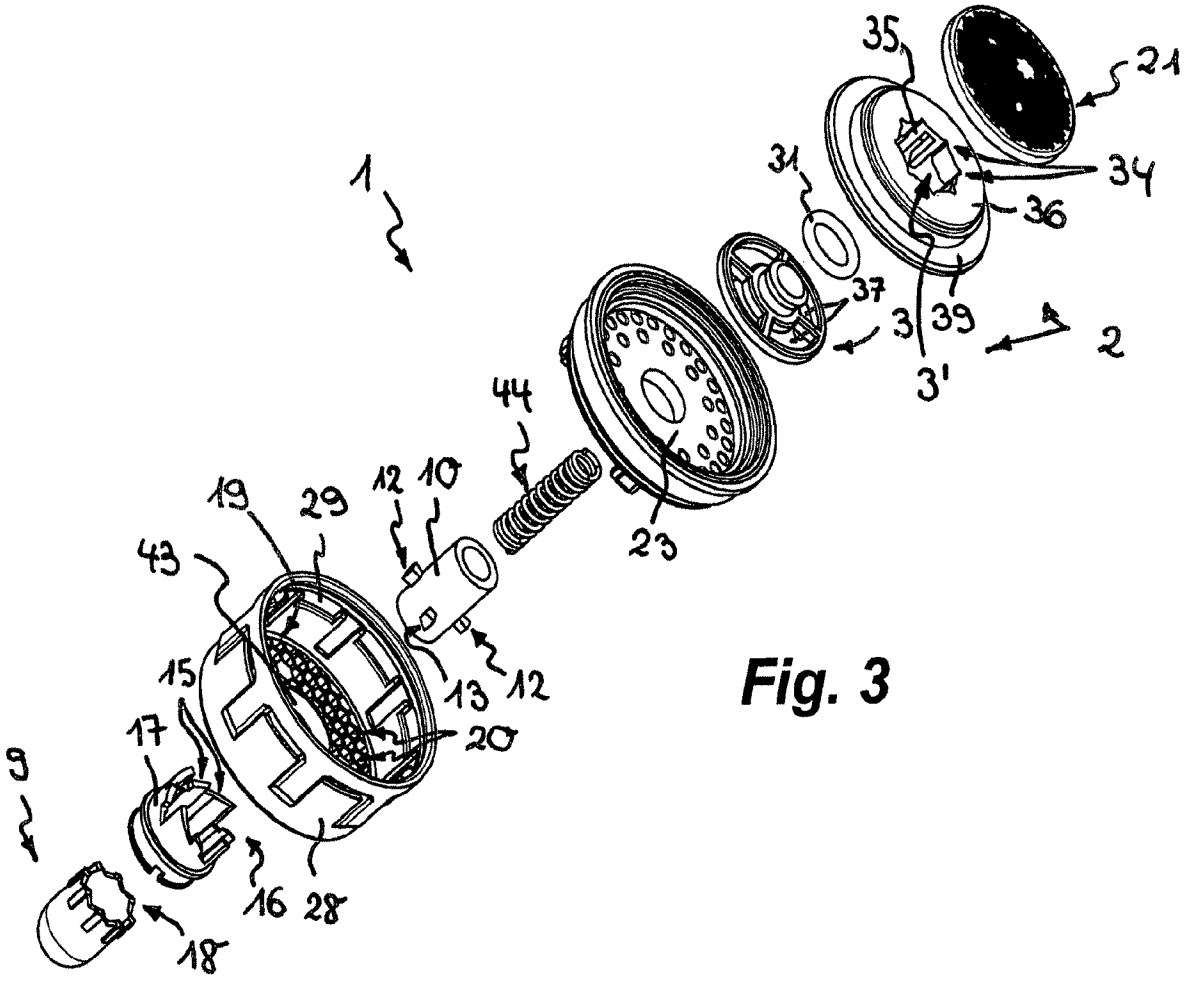
FIG. 3 shows the outlet insert from FIGS. 1 and 2 in an exploded illustration of individual components.
Figure 4:
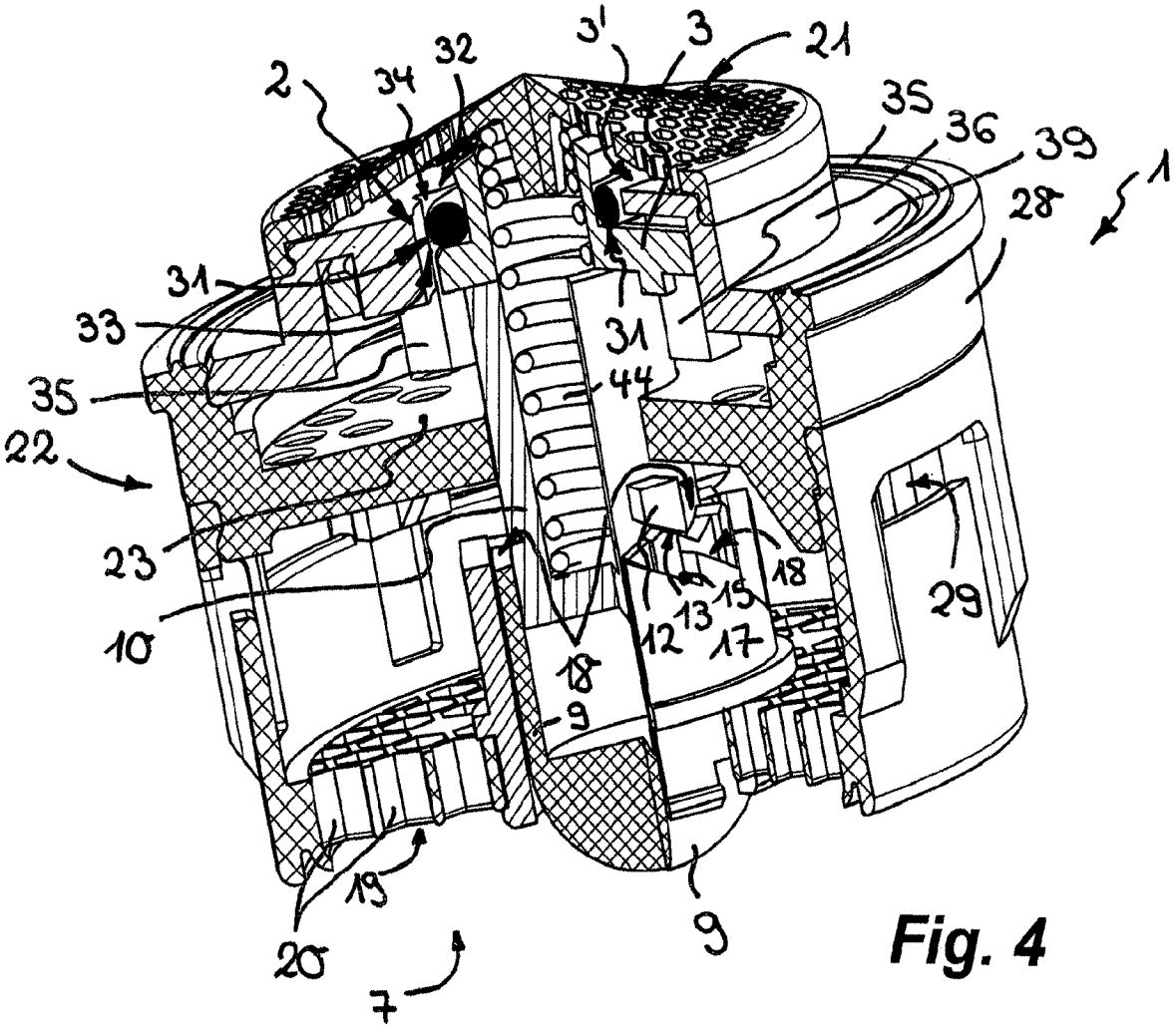
FIG. 4 shows the outlet insert from FIGS. 1 to 3 in a perspective partial longitudinal section.
Figure 6:
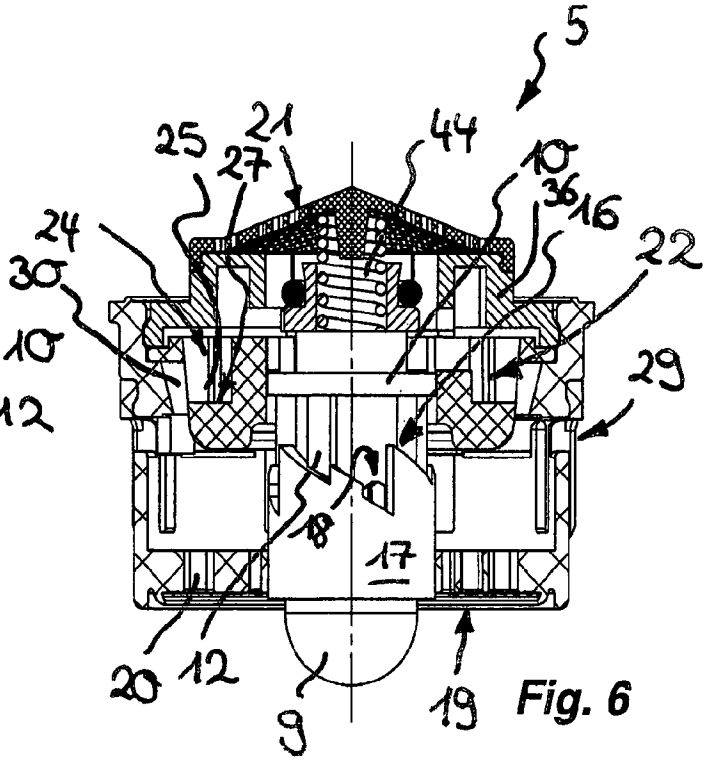
FIG. 6 shows the outlet insert from FIG. 5 in a different operating position from that in FIG. 5.
Figure 5:
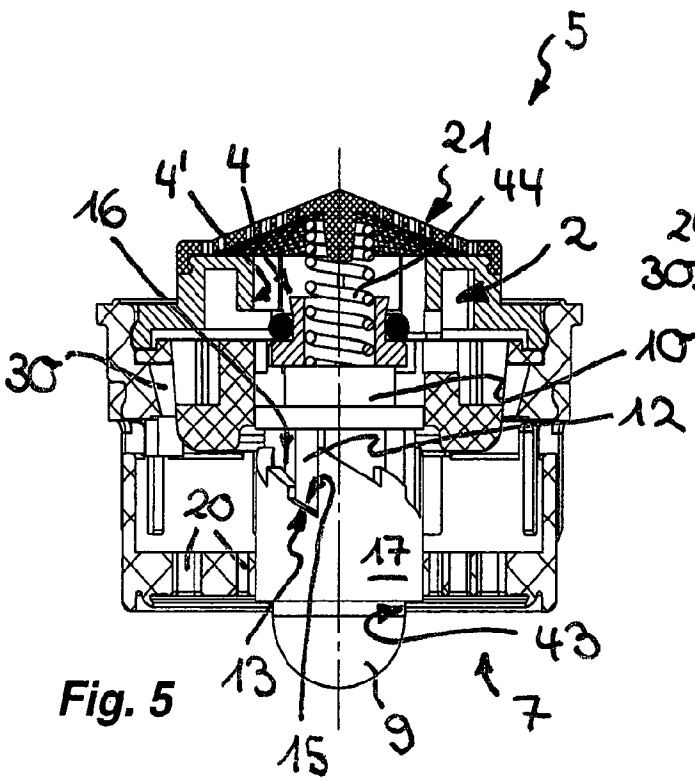
FIG. 5 shows an outlet insert shown in a longitudinal section, which is of comparable design to the outlet insert illustrated in FIGS. 1 to 4, wherein the outflow-side jet regulator belonging to this outlet insert here has a diffuser as a jet divider instead of a perforated plate.
Figure 7:
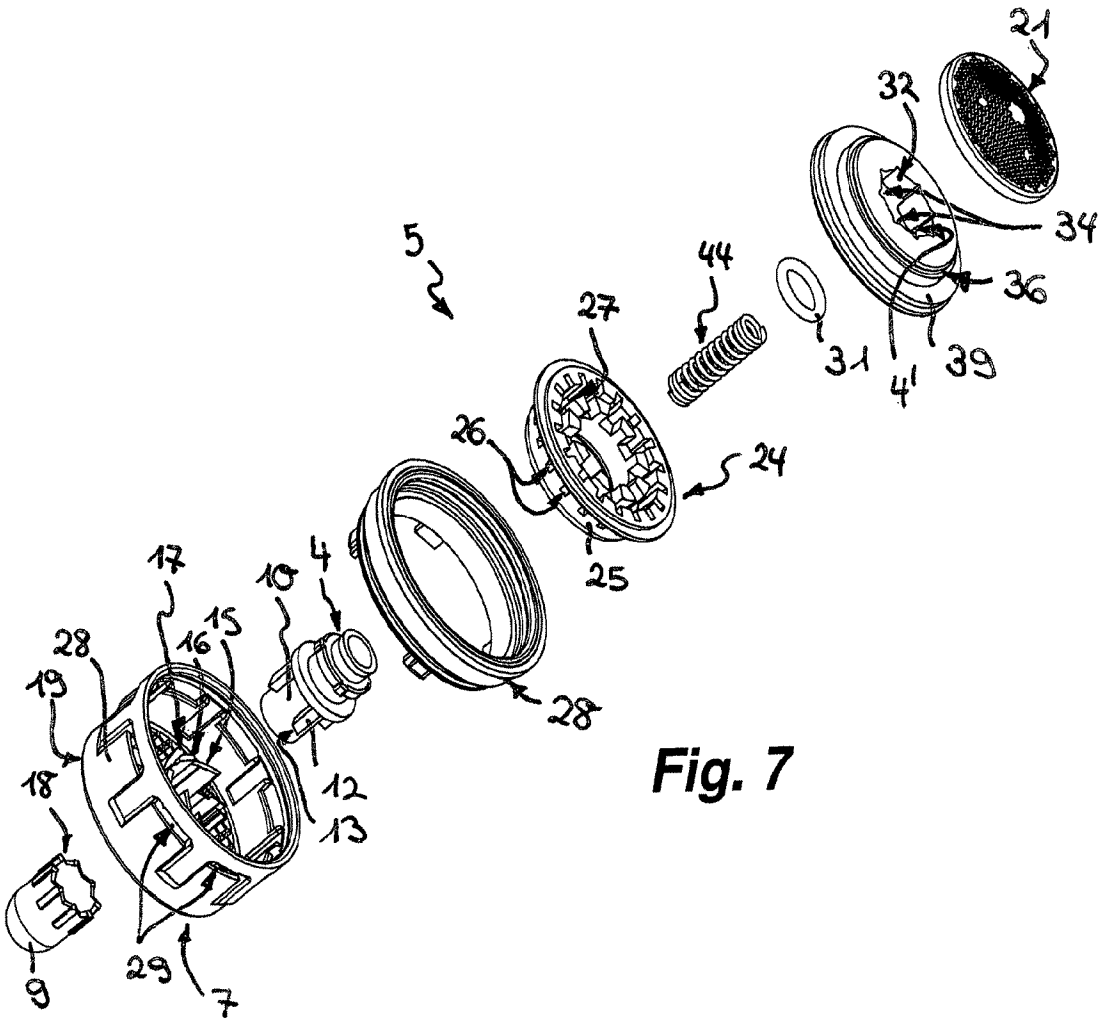
FIG. 7 shows the outlet insert from FIGS. 5 and 6 in an exploded illustration of individual components.

The outlet insert 1 shown in FIGS. 1 to 4 can be adjusted between a "low" setting, shown in FIG. 1, with a reduced flow rate and a "boost" or "high" setting, shown in FIG. 2, with a higher flow rate, in which the adjusting element 3 carrying the throttling body 31 is arranged outside an operative position provided in the region of the counterelement 3'.

Whereas outlet insert 1 has a perforated plate 23 as a jet divider in its jet regulator 22, outlet insert 5, which is likewise of two-step design, has a diffuser 24 as a jet divider, which produces a greatly reduced pressure even at low water pressures in order to draw the ambient air required to aerate the water into the interior of the housing of the jet regulator 5. It will be clear from FIG. 7 that, in outlet insert 5, the front end region of the thruster sleeve 10, said front end region facing the flow rate regulator 2, is simultaneously designed as the adjusting element 4 carrying the throttling body 31.

The outlet insert 8 corresponds to the outlet insert 5 with the exception of the absence of a throttling body in the outlet insert 8. In the case of the outlet insert 8, the adjusting element 38 itself therefore acts as the flow limiter 2', which narrows the flow cross section to the jet regulator in the "low" setting shown in FIG. 9, while this flow cross section is held open relative thereto in the "boost" or "high" setting shown in FIG. 8.

Figure 12:
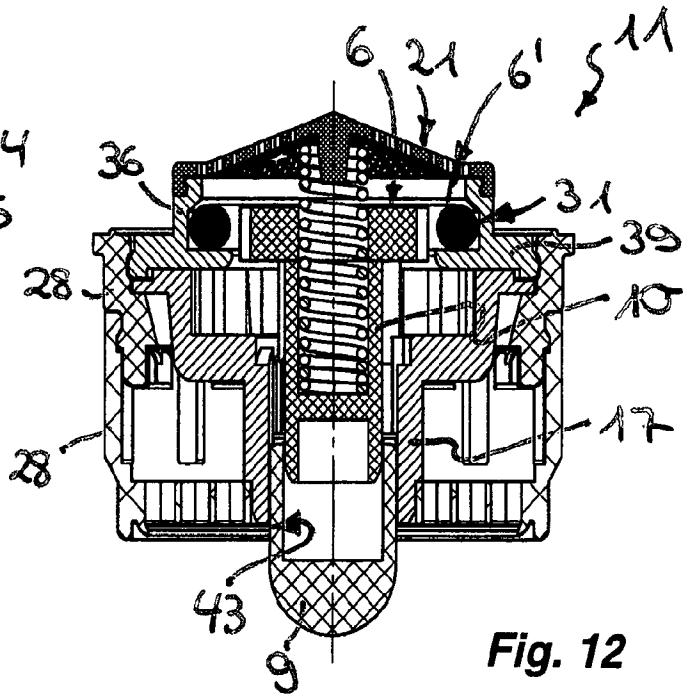
FIG. 12 shows the outlet insert from FIG. 11, likewise illustrated in a longitudinal section, in a different operating position from that in FIG. 11, in which the control core can interact with the throttling body.
Figure 11:
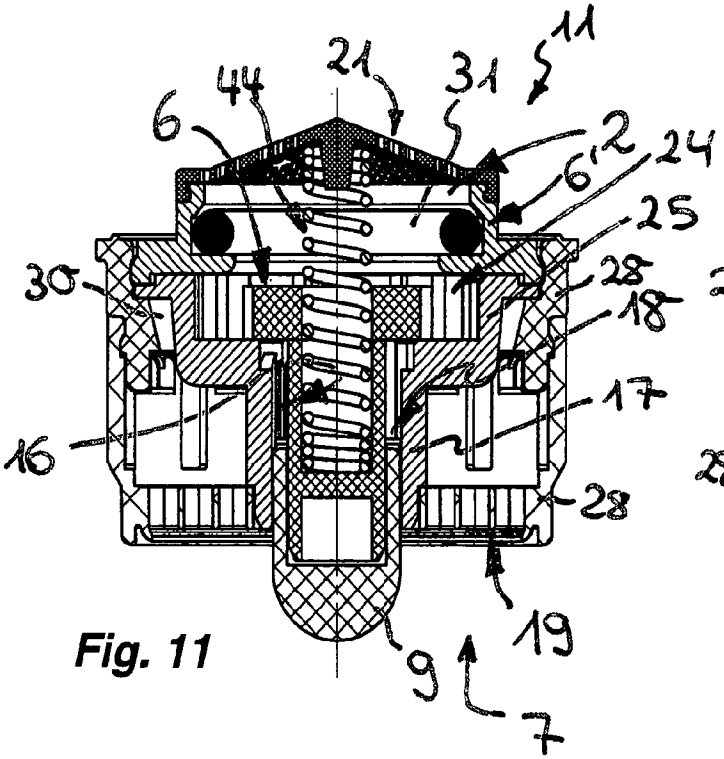
FIG. 11 shows an outlet insert formed by an inflow-side screen attachment, an outflow-side jet regulator and an interposed flow rate regulator in a longitudinal section, wherein here preselection of the flow rate of the flow rate regulator is not accomplished through the ability to adjust the throttling body axially in its position relative to a regulating profile but, on the contrary, through the fact that the control core serving as an adjusting element, which carries the circumferential wall with the regulating profile, can be adjusted axially between two operating positions, and wherein here the control core is illustrated in an operating position in which it is deactivated relative to the throttling body.
Figure 13:
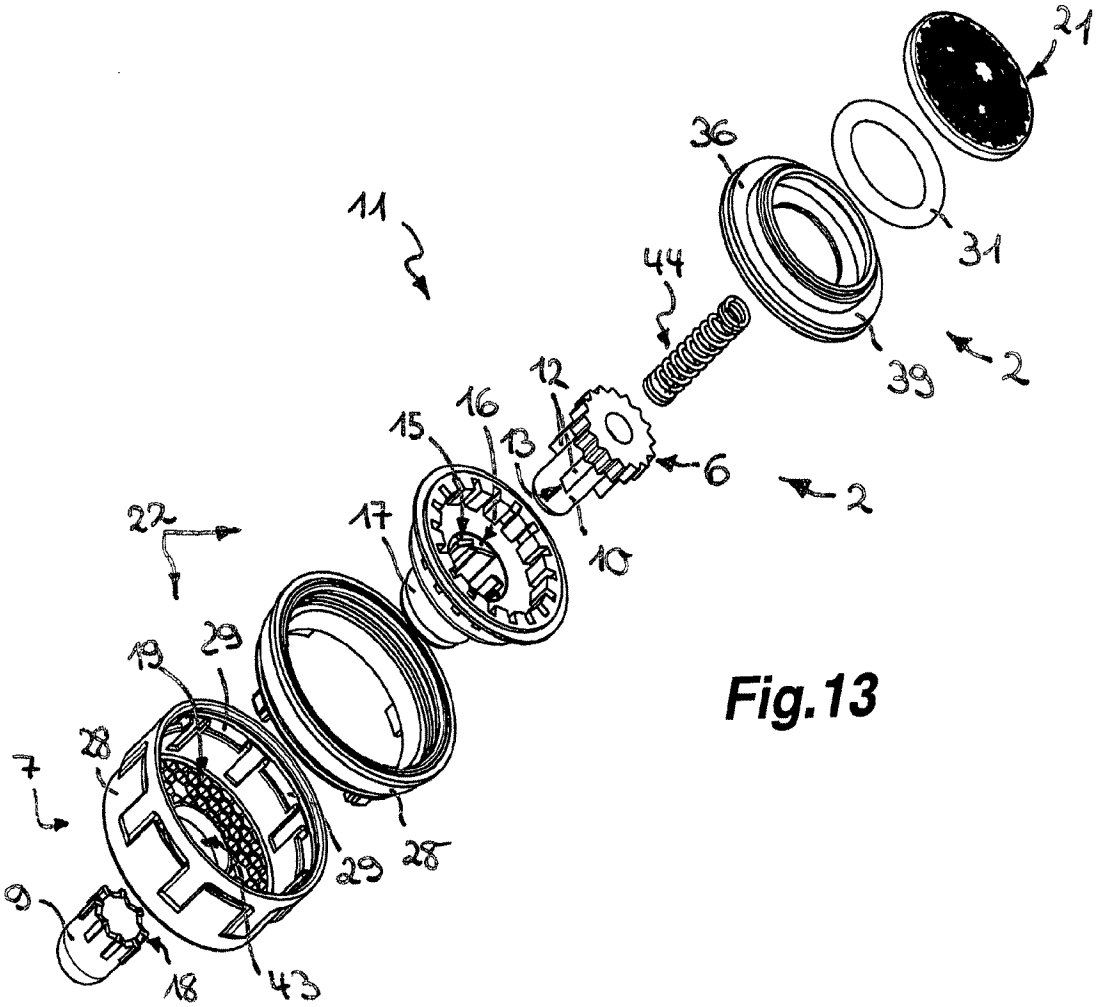
FIG. 13 shows the outlet insert from FIGS. 11 and 12 in an exploded illustration of individual components.
Figure 19:
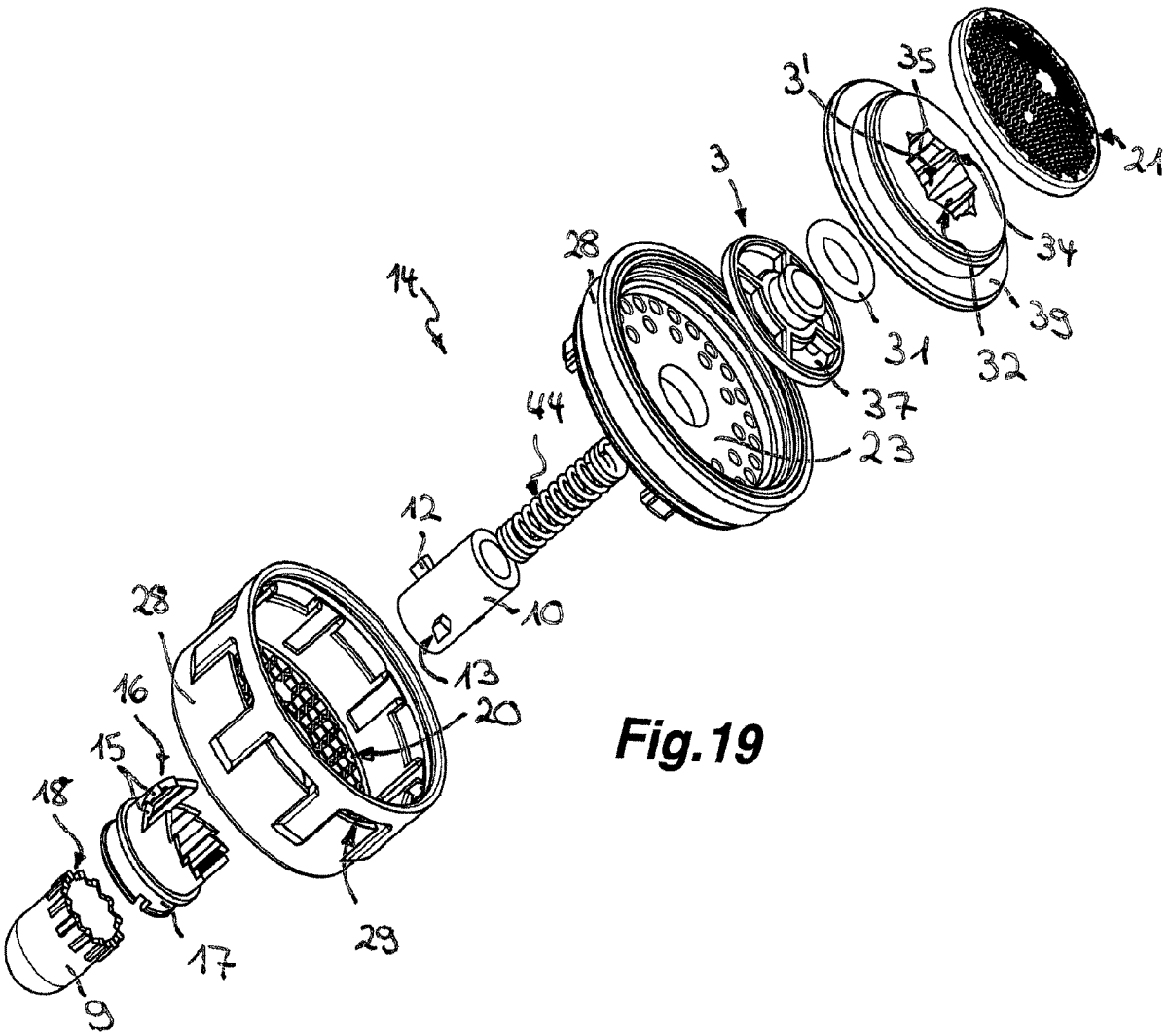
FIG. 19 shows the outlet insert from FIGS. 14 to 18 in an exploded illustration of individual components.

In the case of the two-step outlet insert 11, the adjusting element 6 bearing the regulating profile 32 can be switched between the "boost" or "high" setting shown in FIG. 11 and the "low" setting shown in FIG. 12 in such a way, with the adjusting element 6 being arranged outside an operative position provided in the region of the counterelement 6' in the "boost" setting.

The outlet inserts 14, 50 are of multi-step design. From the stepped set of teeth 16, it can be seen that the outlet insert 14 has four steps, which are distinguished from one another by different flow rates. The outlet insert 14 thus allows switching between the operating positions in the manner of a revolver. Since the outlet insert 14 offers a plurality of operating positions, which can be preselected if required, the outlet insert 14 can also be used as a "universal" jet regulator, which can be adapted to any water pressure in the water systems of the various regions and markets simply by pressure operation.

Figure 21:
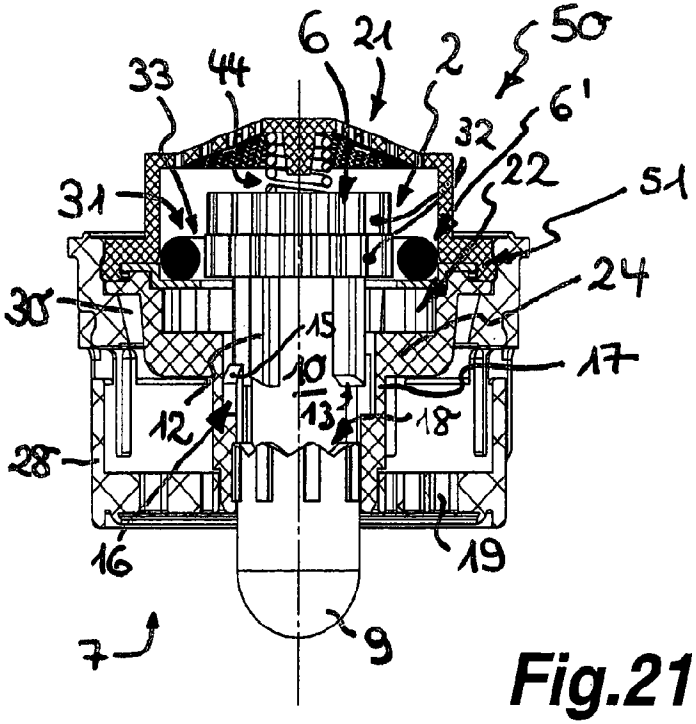
FIG. 21 shows the outlet insert from FIG. 20, likewise shown in a longitudinal section, in the operating position that differs from FIG. 20.
Figure 20:
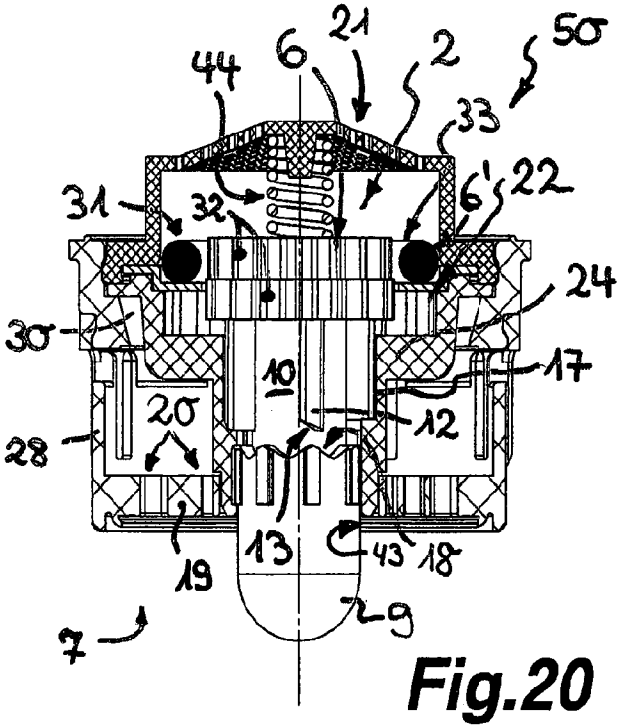
FIG. 20 shows a longitudinal section of an outlet insert that can be inserted into an outlet nozzle and is likewise designed as an insertable cartridge, which outlet insert has, between the inflow-side screen attachment and the outflow-side jet regulator, an interposed flow rate regulator, in which the control core, which interacts with the flexible throttling body, has multiple, in this case two, control core subregions, for example, which have different effective diameters and/or differently acting regulating profiles, such that the flow rate regulator can be adjusted between a corresponding number of operating positions with different flow rates.
Figure 22:
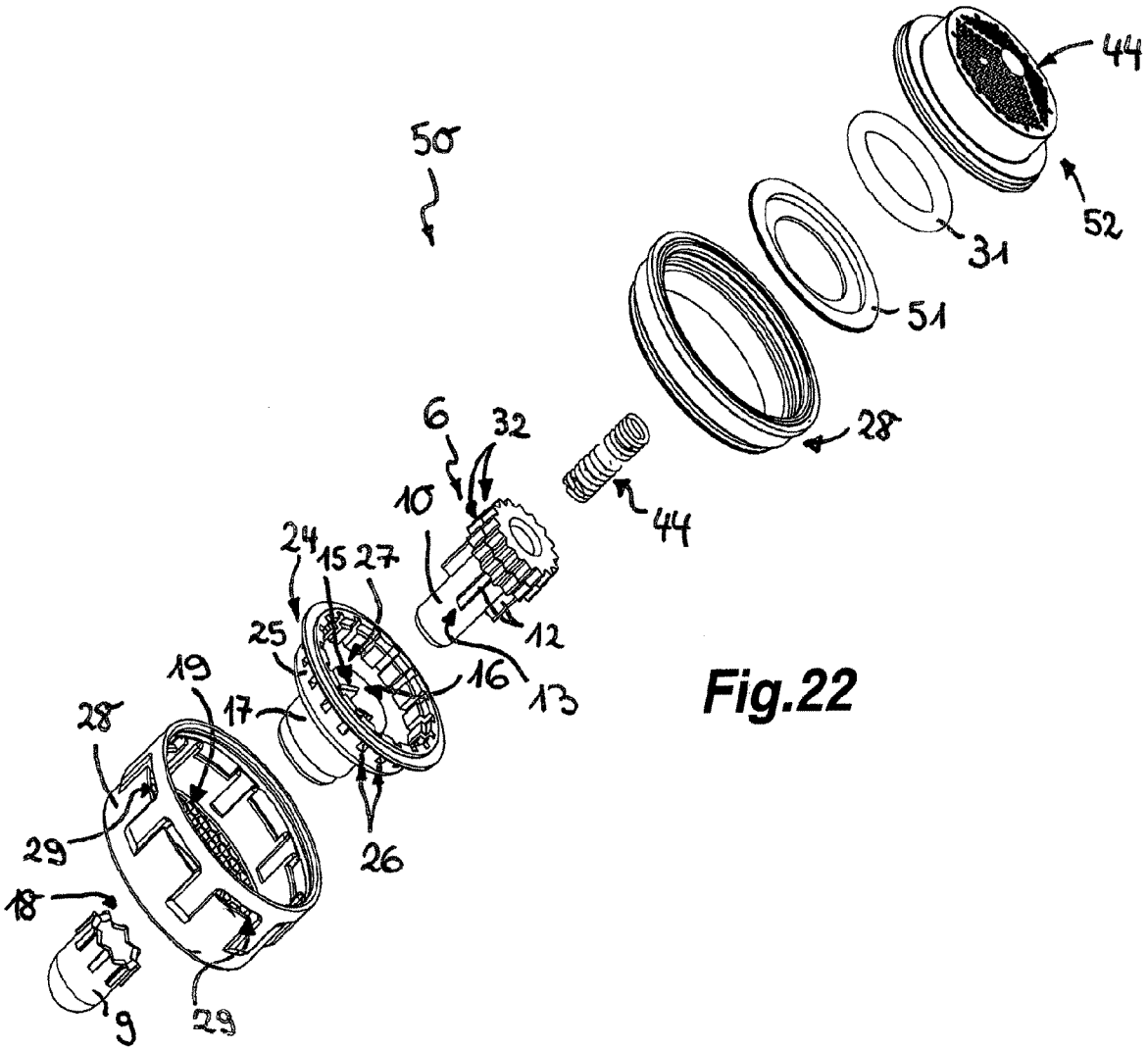
FIG. 22 shows the outlet insert from FIGS. 20 and 21 in an exploded illustration of individual components.

In the case of the outlet insert 50 shown in FIGS. 20 to 22, the regulating core, which is designed as an adjusting element 6 and can be adjusted axially by means of the pushbutton mechanism and can be fixed in the selected operating position, has two regulating core subregions, which bear regulating profiles 32 with different effects and/or—as in the present case—which have different effective diameters. Since the flow rate regulator 2 of the outlet insert 50 has two regulating core subregions which differ in this way and which each interact, in one of the operating positions, with the throttling body 31 acting as a counterelement 6', one of the two flow rates available can be selected at the pushbutton 9.

In FIGS. 1 to 19, it can be seen that the jet regulator housing 28 has a recess on the inflow side thereof, into which the housing 36 of the flow rate regulator 2 or the housing 40 of the flow limiter 2' can be inserted by means of a housing part 39, here designed in the manner of a flange, in a way which allows it to be releasably connected and, in particular, releasably locked. The screen attachment 21, which has a smaller outside diameter than housing subregion 39, is, for its part, held on the inflow side of the flow rate regulator 2 or the flow limiter 2' in a way which allows it to be releasably connected and, in particular, releasably locked.

As will be apparent from FIGS. 20 and 21, in the case of outlet insert 50 the screen attachment 21 and the housing subregion associated with the flow rate regulator 2 are connected integrally to one another to give a single component 52, which component 52 can be locked releasably in the jet regulator housing 28 in such a way that the jet divider, here designed as a diffuser 24, is also simultaneously secured in the interior of the housing. As can be seen in FIGS. 20 to 22, a support element 51 in the form of an annular washer, on the circumferential edge region of which, which projects on the inside, the flexible throttling body 31 rests, is arranged between component 52 and the inflow-side end edge of the diffuser 24.

In the case of the outlet inserts 1, 5, 8, 11, 14, 50 illustrated here, the flow rate can be switched from a setting with a lower flow rate to at least one setting with a higher flow rate and vice versa, simply by exerting pressure on the handle designed as a pushbutton 9, in accordance with the revolver principle. In this way, the outlet inserts 1, 5, 8, 11, 14, 50 can be adapted easily and with little effort to the on-site water pressure and/or to the respective application.

What is claimed is:

1. A sanitary outlet insert (1, 5, 8, 11, 14, 50), which can be mounted on an water outlet of a sanitary outlet fitting, comprising a flow limiter (2') that has an adjusting element (38) which limits a flow cross section of the flow limiter in interaction with a counterelement (38'), a handle is provided on an outflow end (7) of the outlet insert (8) for changing a relative position of the adjusting element (38) and the counterelement (38'), said handle being formed as a pushbutton, and an adjusting movement at the handle is convertible into a relative movement of the adjusting element (38) and the counterelement (38') via a pushbutton mechanism, comprising a pushbutton (9), the flow cross section of the flow limiter (2') is preselectable or variable between a high flow rate and at least one flow rate that is reduced relative to the high flow rate by an axial change of the relative position of the adjusting element (38) and the counterelement (38'), and the outflow end (7) of the outlet insert (8) has a central through opening (43), through which the pushbutton (9) passes, wherein the jet regulator has a jet divider which divides the inflowing water into a multiplicity of individual jets, wherein the jet divider is a diffuser (24), which has an annular wall (25) with through openings (26), and a deflecting surface (27) is formed on the annular wall (25), said deflecting surface deflecting inflowing water to the through openings (26), wherein the jet regulator (22)has a jet regulator housing (28) with a housing subregion which, between itself and the diffuser (24), bounds a through channel (30), the through channel (30) tapers at least in one or more regions in the direction of flow, and the through openings (26) open into the through channel (30).

2. The outlet insert as claimed in claim 1, wherein the pushbutton mechanism has a thruster sleeve (10), by which the relative position of the adjusting element (38) and the counterelement (38') can be changed and the thruster sleeve (10) has at least one sliding tooth (12) with an oblique surface(13), said oblique surface (13) interacts with a circumferential stepped set of teeth (16), such that a pressing movement applied to the pushbutton (9) counter to a restoring force is converted into an axial sliding/turning movement of the sliding tooth (12), which, during this process, slides into a next step of the stepped set of teeth (16).

3. The outlet insert as claimed in claim 2, wherein the stepped set of teeth (16) is of two- or multi-step design.

4. The outlet insert as claimed in claim 3, wherein in one of the stepped set of teeth (16), the adjusting element (38) is arranged outside an operative position provided in a region of the counterelement (38').

5. The outlet insert as claimed in claim 2, wherein the thruster sleeve (10) is guided in a guide sleeve (17), which bears the circumferential stepped set of teeth (16) at one end edge of the sleeve or on an inner circumference of the sleeve.

6. The outlet insert as claimed in claim 5, wherein an outflow-side end wall (19) of the insert unit (1, 5, 8, 11, 14, 50) has a grille, net or hole structure and the guide sleeve (17) is formed integrally or secured on the end wall (19) or on a front end jet divider.

7. The outlet insert as claimed in claim 2, wherein the restoring force is generated by a restoring spring (44).

8. The outlet insert as claimed in claim 5, wherein the pushbutton (9) is guided movably in the guide sleeve (17).

9. The outlet insert as claimed in claim 1, wherein the jet regulator (22) has a jet regulator housing (28) with at least two releasably connectable housing parts.

10. The outlet insert as claimed in claim 1, wherein the jet regulator (22) has a jet regulator housing (28), into a housing interior of which at least one inserted part having a hole, grille or net structure can be inserted.

11. The outlet insert as claimed in claim 1, wherein the adjusting element (38) is guided for axial adjustment.

12. The outlet insert as claimed in claim 1, wherein the pushbutton is produced from a transparent or semitransparent material in order to indicate a selected operating position.

13. A sanitary outlet insert (1, 5, 8, 11, 14, 50), which can be mounted on an water outlet of a sanitary outlet fitting, comprising o flow limiter (2') that has an adjusting element (38) which limits a flow cross section of the flow limiter in interaction with a counterelement (38'), a handle is provided on an outflow end (7) of the outlet insert (8) for changing a relative position of the adjusting element (38) and the counterelement (38'), said handle being formed as a pushbutton, and an adjusting movement at the handle is convertible into a relative movement of the adjusting element (38) and the counterelement (38') via a pushbutton mechanism, comprising a pushbutton (9), the flow cross section of the flow limiter (2') is preselectable or variable between a high flow rate and at least one flow rate that is reduced relative to the high flow rate by an axiel change of the relative position of the adjusting element (38) and the counterelement (38'), and the outflow end (7) of the outlet insert (8) has a central through opening (43), through which the pushbutton (9) passes, the pushbutton mechanism having a thruster sleeve (10), by which the relative position of the adjusting element (38) and the counterelement (38') can be changed and the thruster sleeve (10) has at least one sliding tooth (12) with an oblique surface (13), said oblique surface (13) interacts with a circumferential stepped set of teeth (16), such that a pressing movement applied to the pushbutton (9) counter to a restoring force is converted into an axial sliding/turning movement of the sliding tooth (12), which, during this process, slides into a next step of the stepped set of teeth (16), the restoring force being generated by a restoring spring (44), wherein the restoring spring (44) passes through the thruster sleeve (10).

* * * * *